US012134830B2

(12) United States Patent
Chen et al.

(10) Patent No.: US 12,134,830 B2
(45) Date of Patent: Nov. 5, 2024

(54) SEALING FOR ANODIZED METAL

(71) Applicant: RTX Corporation, Farmington, CT (US)

(72) Inventors: Lei Chen, South Windsor, CT (US); James O. Hansen, Glastonbury, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 17/077,181

(22) Filed: Oct. 22, 2020

(65) Prior Publication Data

US 2022/0127745 A1 Apr. 28, 2022

(51) Int. Cl.

| | |
|---|---|
| ***C25D 11/24*** | (2006.01) |
| ***C23C 22/56*** | (2006.01) |
| ***C23C 22/73*** | (2006.01) |
| ***C23C 22/83*** | (2006.01) |
| ***C23F 11/18*** | (2006.01) |

(52) U.S. Cl.

CPC ..... *C25D 11/246* (2013.01); *C23C 22/56* (2013.01); *C23C 22/73* (2013.01); *C23C 22/83* (2013.01); *C23F 11/187* (2013.01)

(58) Field of Classification Search

CPC ..... C25D 11/246; C23C 22/56; C23C 22/73; C23C 22/83

See application file for complete search history.

(56) References Cited

U.S. PATENT DOCUMENTS

| | | | | |
|---|---|---|---|---|
| 3,790,453 A | | 2/1974 | Wanamaker et al. | |
| 3,852,124 A | * | 12/1974 | Fassell | C25D 11/246 148/261 |
| 4,504,325 A | * | 3/1985 | Moji | C25D 11/246 148/272 |
| 9,702,053 B2 | | 7/2017 | Maloney et al. | |
| 9,879,347 B2 | | 1/2018 | Bares et al. | |
| 10,480,093 B2 | | 11/2019 | Van Hassel et al. | |
| 10,760,164 B2 | | 9/2020 | Ding et al. | |
| 2013/0011688 A1 | | 1/2013 | Beaver | |
| 2018/0274121 A1 | * | 9/2018 | Ding | C25D 11/20 |

FOREIGN PATENT DOCUMENTS

| | | | |
|---|---|---|---|
| EP | 3382064 A2 | | 10/2018 |
| JP | H05311458 A | * | 11/1993 |
| WO | 9615296 A1 | | 5/1996 |

OTHER PUBLICATIONS

European Search Report Issued Feb. 28, 2022; Application No. 21200469.1 (10 pages).

Yaffe, "Sealing of Anodized Aluminum—a Review", 1252 Metal Finishing, No. 5, May 1990 (5 pages).

* cited by examiner

*Primary Examiner* — Tabatha L Penny

(74) *Attorney, Agent, or Firm* — CANTOR COLBURN LLP

(57) ABSTRACT

A sealing process includes impregnating an oxide layer of an anodized metal with a corrosion inhibitor by contacting the oxide layer with a first corrosion inhibitor solution at a first temperature and sealing the impregnated oxide layer of an anodized metal by contacting the impregnated oxide layer with a second corrosion inhibitor solution at a second temperature, wherein the first corrosion inhibitor solution has a corrosion inhibitor concentration greater than the second corrosion inhibitor solution and the first temperature is less than the second temperature.

8 Claims, No Drawings

SEALING FOR ANODIZED METAL

BACKGROUND

Exemplary embodiments pertain to the art of chromate sealing for anodized metals.

Anodized metals such as high strength aluminum alloys are used in a variety of applications and can be subjected to harsh conditions. In some instances, the anodized metals can experience corrosion as a result of exposure to heavy air pollution. The corrosion can include both inter-granular attack and localized corrosion such as pitting. While currently available sealing processes can reduce the amount of corrosion better protection is desired.

BRIEF DESCRIPTION

Disclosed is a sealing process including impregnating an oxide layer of an anodized metal with a corrosion inhibitor at a first temperature by contacting the oxide layer with a first corrosion inhibitor solution and sealing the impregnated oxide layer of the anodized metal by contacting the impregnated oxide layer with a second corrosion inhibitor solution at a second temperature, wherein the first corrosion inhibitor solution has a corrosion inhibitor concentration greater than the second corrosion inhibitor solution and the first temperature is less than the second temperature.

In addition to one or more of the features described above, or as an alternative to any of the foregoing embodiments, the first corrosion inhibitor solution and the second corrosion inhibitor solution include chromate. In some embodiments the first and second corrosion inhibitor solutions include a trivalent chrome compound.

In addition to one or more of the features described above, or as an alternative to any of the foregoing embodiments, the first corrosion inhibitor solution may have a corrosion inhibitor concentration greater than or equal to 200 parts per million (ppm) and less than or equal to 30,000 ppm. The first corrosion inhibitor solution may have a corrosion inhibitor concentration greater than or equal to 1,000 parts per million (ppm) and less than or equal to 15,000 ppm.

In addition to one or more of the features described above, or as an alternative to any of the foregoing embodiments, the second corrosion inhibitor solution may have a corrosion inhibitor concentration greater than or equal to 10 parts per million (ppm) and less than or equal to 200 ppm. The second corrosion inhibitor solution may have a corrosion inhibitor concentration greater than or equal to 15 parts per million (ppm) and less than or equal to 100 ppm.

In addition to one or more of the features described above, or as an alternative to any of the foregoing embodiments, the anodized metal includes anodized aluminum.

In addition to one or more of the features described above, or as an alternative to any of the foregoing embodiments, the first corrosion inhibitor solution has a pH greater than the second corrosion inhibitor solution. The first corrosion inhibitor solution may have a pH greater than or equal to 4.0 and less than or equal to 7.5 and the second corrosion inhibitor solution may have a pH greater than or equal to 3.0 and less than or equal to 4.0.

In addition to one or more of the features described above, or as an alternative to any of the foregoing embodiments, contacting the oxide layer with the first corrosion inhibitor solution occurs for less time than contacting the impregnated oxide layer with the second corrosion inhibitor solution. The contact time with the first corrosion inhibitor solution may be greater than or equal to 1 minute and less than or equal to 20 minutes and the contact time with the second corrosion inhibitor solution may be greater than or equal to 10 minutes and less than or equal to 30 minutes.

In addition to one or more of the features described above, or as an alternative to any of the foregoing embodiments, the first temperature may be greater than or equal to 10° C. and less than or equal to 90° C.

In addition to one or more of the features described above, or as an alternative to any of the foregoing embodiments, the second temperature may be greater than or equal to 70° C. and less than or equal to 100° C.

Also disclosed is a sealed anodized metal having an oxide layer. The oxide layer has an interior portion proximate to the metal and an exterior portion distal to the metal. The interior portion includes corrosion inhibitor and the exterior portion includes corrosion inhibitor and oxy-hydroxide compounds of the metal. The concentration of corrosion inhibitor in the interior portion is greater than the concentration of corrosion inhibitor in the exterior portion.

In addition to one or more of the features described above, or as an alternative to any of the foregoing embodiments, the corrosion inhibitor includes chromate.

In addition to one or more of the features described above, or as an alternative to any of the foregoing embodiments, the corrosion inhibitor includes a compound such as trivalent chrome as an inhibitor.

In addition to one or more of the features described above, or as an alternative to any of the foregoing embodiments, the anodized metal includes anodized aluminum.

The sealed anodized metal can be used in an aerospace component such as a stator vane, fan case or shroud for a gas turbine engine.

DETAILED DESCRIPTION

A detailed description of one or more embodiments of the disclosed apparatus and method are presented herein by way of exemplification and not limitation.

Anodizing is an electrolytic passivation process where a metal article operates as an anode in an electrical circuit and an oxide layer is grown on the surface of the article as a result of converting a metallic element (that is part of the metal article) to oxides and related compounds. The anodizing process is commonly used to create an oxide layer on aluminum alloys. The as-made oxide layer is porous, thus incapable of protecting the underlaying metal from corrosion.

To improve the corrosion resistance of anodized metals, the oxide layer may be sealed physically to reduce porosity. Further enhancement of the corrosion protection can result from infiltrating the pores with a corrosion inhibitor. As mentioned above the oxide layer is porous and sealing the oxide layer is intended to prevent corrosion causing substances from reaching the underlying metal. Currently known sealing processes are generally combined with a corrosion inhibitor treatment in a single step. Sealing in hot water involves converting alumina to lower density boehmite, aluminum oxy hydroxide (AlO(OH)), according to the following reaction:

$$Al_2O_3+H_2O=2AlO(OH)$$

In the presence of dilute chromate and di-chromate, additional reaction with chromate can occur, for example forming aluminum oxydichromate, $AlOHCrO_4$.

$$Al_2O_3+2HCrO_4^-+H_2O=2AlOHCrO_4+2OH^-$$

One drawback of the single bath sealing operation is that the conversion of alumina to boehmite or aluminum oxydichromate can compete with the infiltration of corrosion inhibitors and even impede corrosion inhibitor impregnation as the sealing process progresses. On the other hand, measures taken to facilitate the impregnation of higher concentration corrosion inhibitors tends to attenuate or even retard the conversion of alumina to the desired species aforementioned, resulting in a higher number of defects and less effective physical sealing, hence compromising corrosion resistance.

Defects in anodization film and insufficient amount of corrosion inhibitors wherein can lead to premature corrosion of the substrate aluminum alloys. The failure can occur more rapidly and become more severe in the regions where air pollution produces a more aggressive chemical environment via precipitation, leading to localized corrosion such as pitting and inter-granular attacks. Localized corrosion is detrimental for structural materials as cracks can initiate from the corrosion sites at a stress load lower than what the material is designed for. To improve material durability in environments challenging for anodized aluminum components, each of the two performance attributes of an anodization film, film density and inhibitor concentration, need to be optimized without debiting one another.

Using the method disclosed herein, the oxide layer of the anodized metal is impregnated with a corrosion inhibitor by contacting the oxide layer with a first corrosion inhibitor solution at a first temperature. The impregnated oxide layer may then be rinsed with water, but preferably is only drained briefly to maximize the uptake of the corrosion inhibitor. The impregnated oxide (with or without rinsing) is then sealed by contacting the impregnated oxide layer with a second corrosion inhibitor solution at a second temperature. The concentration of corrosion inhibitor in the first corrosion inhibitor solution is greater than the concentration of corrosion inhibitor in the second corrosion inhibitor solution. Additionally, the first temperature is less than the second temperature. The pH of the first corrosion inhibitor solution is greater than the pH of the second corrosion inhibitor solution. The contact time with the first corrosion inhibitor solution is less than the contact time with the second inhibitor solution.

Without being bound by theory it is believed that by contacting the oxide layer of the anodized metal with a corrosion inhibitor solution having a higher concentration of corrosion inhibitor, lower temperature and a higher pH than typically used in a sealing step the chemical composition and porous morphology of the oxide layer is retained thus allowing the corrosion inhibitor to penetrate and remain in the porous oxide interior. This impregnation is then followed by a sealing step in which the higher temperature and lower pH facilitates the transformation of the oxide to an oxy hydroxide (AlO(OH) when the metal is aluminum) that forms a physical barrier to corrosion materials.

The corrosion inhibitor includes chromate (hexavalent chromium oxide) or one or more trivalent chromium compounds. The first corrosion inhibitor solution has a corrosion inhibitor concentration greater than or equal to 200 parts per million (ppm) and less than or equal to 30,000 ppm. Within this range the concentration may be greater than or equal to 1,000 ppm or greater than or equal to 3,000 ppm. Also, within this range the concentration may be less than or equal to 15,000 ppm or less than or equal to 10,000 ppm. The chromate concentration of the first corrosion inhibitor solution is greater than the chromate concentration of the second corrosion inhibitor solution.

The second corrosion inhibitor solution has a corrosion inhibitor concentration greater than or equal to 10 parts per million (ppm) and less than or equal to 200 ppm. Within this range the concentration may be greater than or equal to 15 ppm or greater than or equal to 20 ppm. Also, within this range the concentration may be less than or equal to 100 ppm or less than or equal to 50 ppm.

The chemistry of the corrosion inhibitors in the first and second baths is substantially similar. Substantially similar is defined as using the same corrosion inhibitors which can ease any cross-contamination issues during manufacturing. The first corrosion inhibitor solution may include additional stabilizers to facilitate the efficacy of impregnation consistently during operation. For example, the first corrosion inhibitor solution may include various pH stabilizing compositions such as acetic acid/sodium acetate mixture or citric acid/sodium citrate or borax ($Na_2B_4O_7.10H_2O$)/boric acid $H_3BO_3$).

The oxide layer is contacted with the first corrosion inhibitor solution at a first temperature. The first temperature is greater than or equal to 10° C. and less than or equal to 90° C. Within this range the first temperature may be greater than or equal to 12° C., or greater than or equal to 15° C. Also, within this range the first temperature may be less than or equal to 60° C. or less than or equal to 35° C. The first temperature is less than the second temperature.

The impregnated oxide layer is contacted with a second corrosion inhibitor solution at a second temperature. The second temperature is greater than or equal to 70° C. and less than or equal to 100° C. Within this range the second temperature may be greater than or equal to 80° C., or greater than or equal to 90° C. Also, within this range the first temperature may be less than or equal to 98° C. or less than or equal to 95° C.

The pH of the first corrosion inhibitor solution is greater than or equal to 4.0 and less than or equal to 7.5. Within this range the pH may be greater than or equal to 5.4, or greater than or equal to 5.6. Also, within this range the pH may be less than or equal to 6.8, or less than or equal to 6.6.

The pH of the second corrosion inhibitor solution is greater than or equal to 3.0 and less than or equal to 4.0. Within this range the pH may be greater than or equal to 3.2. Also, within this range the pH may be less than or equal to 3.9.

The contact time with the first corrosion inhibitor solution is greater than or equal to 1 minute and less than or equal to 20 minutes. The contact time with the second corrosion inhibitor solution is greater than or equal to 10 minutes and less than or equal to 30 minutes. The contact time with the first corrosion inhibitor solution may be less than the contact time with the second corrosion inhibitor solution.

A series of samples of anodized aluminum alloy was contacted with a series of first solutions having a chromate concentration of 1,000 to 20,000 ppm and a pH of 4.0 to 7.4. The samples were contacted with the solutions at temperatures of 10 to 30° C. for between 1 and 10 minutes. The samples were then sealed using a solution having a chromate concentration of 14 to 100 ppm and a pH of 3.2-3.9 at a temperature of 90-95° C. for 15-25 minutes. The samples were subjected to an aggressive acidic solution containing chloride and sulfate for 48 hours. For comparison, a sample was subjected to a solution having a chromate concentration of 14 to 100 ppm and a pH of 3.2-3.9 at a temperature of 90-95° C. for 15-25 minutes and then subjected to an aggressive acidic solution containing chloride and sulfate for 48 hours. The samples subjected to the two-step process showed more than an 80% decrease in inter-granular attack compared to the sample subjected to sealing alone.

The above described method results in a sealed anodized metal having an oxide layer. The oxide layer has an interior portion proximate to the metal and an exterior portion distal to the metal. The interior portion includes corrosion inhibitor and the exterior portion includes corrosion inhibitor, oxy-hydroxide and oxydichromate compounds of the metal. The concentration of corrosion inhibitor in the interior portion is greater than the concentration of corrosion inhibitor in the exterior portion. The sealed anodized metal is useful in a range of aerospace components including stator vanes, fan cases and shrouds for gas turbine engines.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A sealing process comprising:

impregnating an oxide layer of an anodized metal with a corrosion inhibitor by contacting the oxide layer with a first corrosion inhibitor solution at a first temperature and sealing the impregnated oxide layer of the anodized metal by contacting the impregnated oxide layer with a second corrosion inhibitor solution at a second temperature, wherein the first corrosion inhibitor solution has a corrosion inhibitor concentration greater than or equal to 1,000 parts per million (ppm) and less than or equal to 15,000 ppm, and the first temperature is less than the second temperature, and the first corrosion inhibitor solution has a pH greater than the second corrosion inhibitor solution;

wherein the second corrosion inhibitor solution has a corrosion inhibitor concentration greater than or equal to 10 ppm and less than or equal to 200 ppm; and wherein the oxide layer has an interior portion proximate to the metal and an exterior portion distal to the metal and the interior portion includes corrosion inhibitor and the exterior portion includes corrosion inhibitor and oxy-hydroxide compounds of the metal;

wherein the first corrosion inhibitor solution and the second corrosion inhibitor solution comprise chromate or a trivalent chromium compound;

wherein contacting the oxide layer with the first corrosion inhibitor solution occurs for less time than contacting the impregnated oxide layer with the second corrosion inhibitor solution; and wherein the first temperature is greater than or equal to 10° C. and less than or equal to 60° C.

2. The sealing process of claim 1, wherein the second corrosion inhibitor solution has a corrosion inhibitor concentration greater than or equal to 15 parts per million (ppm) and less than or equal to 100 ppm.

3. The sealing process of claim 1, wherein the anodized metal comprises anodized aluminum.

4. The sealing process of claim 1, wherein the first corrosion inhibitor solution has a pH greater than or equal to 4.0 and less than or equal to 7.5 and the second corrosion inhibitor solution has a pH greater than or equal to 3.0 and less than or equal to 4.0.

5. The sealing process of claim 1, wherein a contact time with the first corrosion inhibitor solution is greater than or equal to 1 minute and less than or equal to 20 minutes and a contact time with the second corrosion inhibitor solution is greater than or equal to 10 minutes and less than or equal to 30 minutes.

6. The sealing process of claim 1, wherein the first temperature is greater than or equal to 10° C. and less than or equal to 35° C.

7. The sealing process of claim 1, wherein the second temperature is greater than or equal to 70° C. and less than or equal to 100° C.

8. The sealing process of claim 1, wherein the concentration of corrosion inhibitor in the interior portion is greater than the concentration of corrosion inhibitor in the exterior portion.

* * * * *